US005913257A

United States Patent [19]

Schaller et al.

[11] Patent Number: 5,913,257

[45] Date of Patent: Jun. 15, 1999

[54] METHOD OF MANUFACTURING GUITAR STRINGS, AND GUITAR STRINGS RESULTING FROM SUCH METHOD

[75] Inventors: Helmut Schaller, Feucht; René Schaller, Pyrbaum, both of Germany

[73] Assignee: Fender Musical Instruments Corp., Scottsdale, Ariz.

[21] Appl. No.: 08/923,768

[22] Filed: Sep. 2, 1997

Related U.S. Application Data

[63] Continuation of application No. 08/643,625, May 6, 1996, abandoned.

[51] Int. Cl.[6] ..... G10D 3/00

[52] U.S. Cl. ..... 84/297 S; 29/515

[58] Field of Search ..... 84/297 S; 29/515, 29/516, 517

[56] References Cited

U.S. PATENT DOCUMENTS

| | | | |
|---|---|---|---|
| 2,535,143 | 12/1950 | Kosmis, Jr. | 84/297 |
| 3,313,196 | 4/1967 | Mari | 84/297 |
| 3,559,270 | 2/1971 | Beghi | 29/282 |
| 3,777,613 | 12/1973 | Chaffee et al. | 84/297 |
| 3,846,888 | 11/1974 | Chaffee et al. | 29/200 B |
| 3,881,236 | 5/1975 | Chaffee et al. | 29/169.5 |
| 4,027,519 | 6/1977 | Bachle | 72/367 |
| 4,034,456 | 7/1977 | Bowers | 29/788 |
| 4,037,506 | 7/1977 | How | 84/297 S |
| 4,138,919 | 2/1979 | Miller | 84/297 R |
| 4,164,806 | 8/1979 | Stone et al. | 29/517 |
| 4,184,405 | 1/1980 | How | 84/297 S |
| 4,326,444 | 4/1982 | Markley | 84/297 S |
| 4,581,976 | 4/1986 | Ball | 84/297 S |
| 4,696,218 | 9/1987 | Hoshino et al. | 84/297 R |
| 4,829,871 | 5/1989 | Manson | 84/297 |
| 5,361,667 | 11/1994 | Pritchard | 84/297 R |
| 5,372,057 | 12/1994 | Hart | 84/297 R |
| 5,477,764 | 12/1995 | Carrico | 84/297 R |

FOREIGN PATENT DOCUMENTS

| | | | |
|---|---|---|---|
| 0120363 | 10/1984 | European Pat. Off. | G10D 3/10 |
| 0551912A2 | 7/1993 | European Pat. Off. | G10D 3/10 |

*Primary Examiner*—William M. Shoop, Jr.
*Assistant Examiner*—Shih-yung Hsieh
*Attorney, Agent, or Firm*—Oppenheimer Wolff & Donnelly LLP

[57] ABSTRACT

A guitar string, in which an end of the string element is threaded into an enlarged end formed of metal, such enlarged end having been forced radially-inwardly all around the string element end so as to very tightly grip it. A method of making a guitar string, in which the string element end is threaded into a hole in a metal blank. Thereafter, such blank and string element are passed through an extrusion die to make such blank longer and smaller in diameter, to cause such blank to grip the end with great force.

43 Claims, 4 Drawing Sheets

FIG. 3.
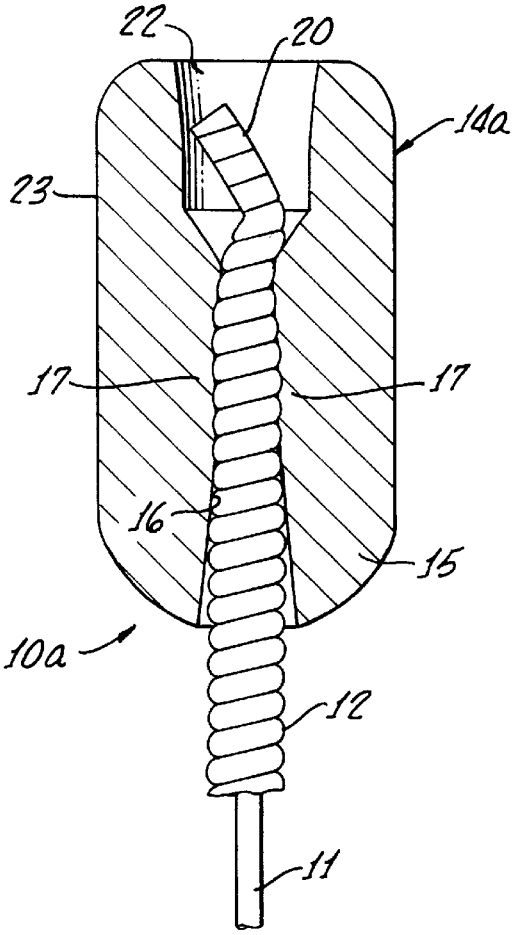
FIG. 4.
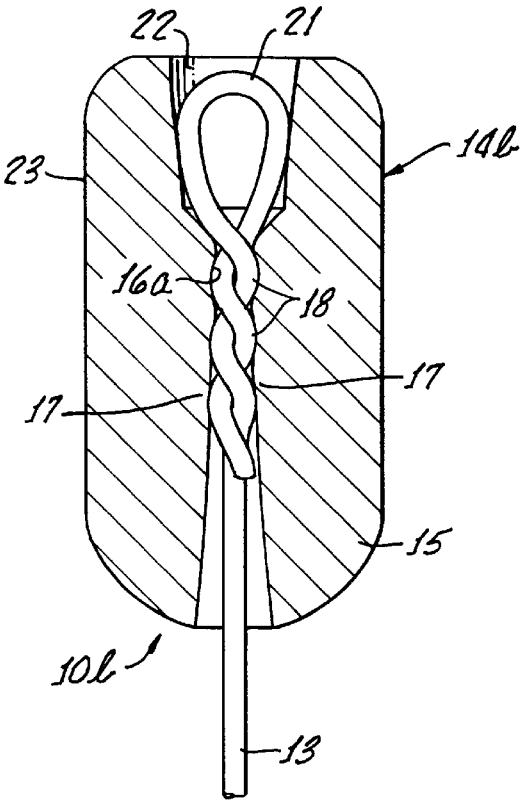
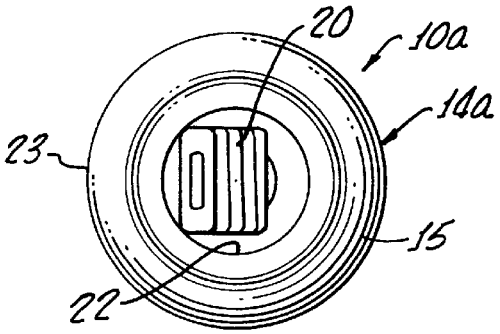
FIG. 5.
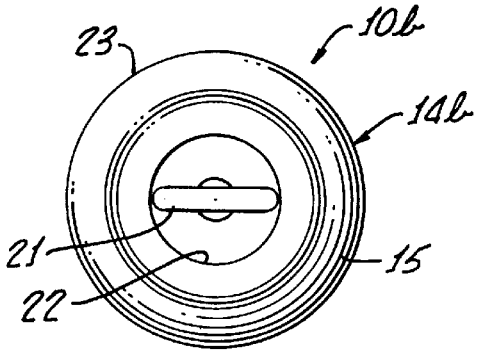
FIG. 6.

FIG. 7.
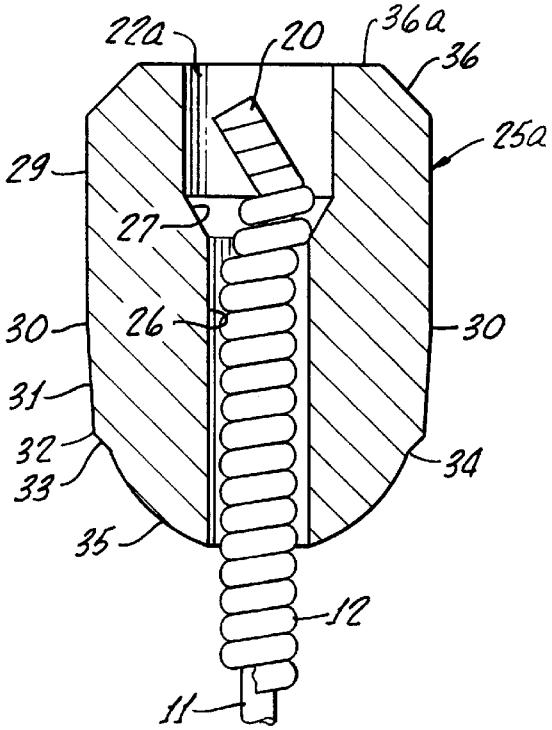
FIG. 8.
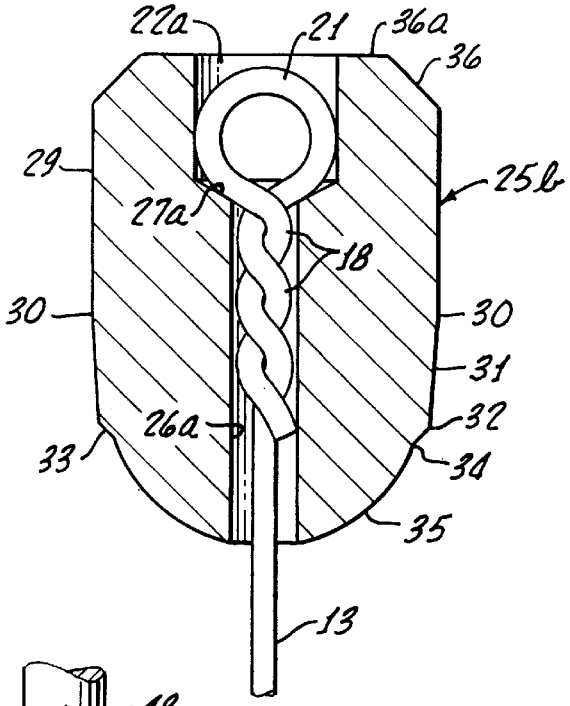
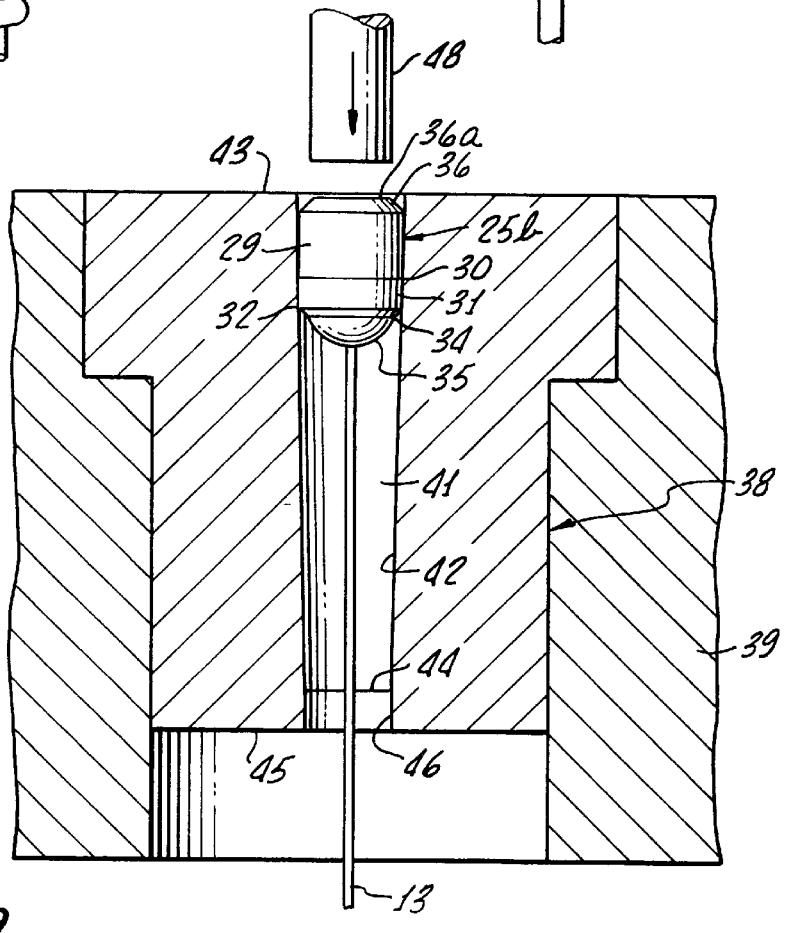
FIG. 9.

METHOD OF MANUFACTURING GUITAR STRINGS, AND GUITAR STRINGS RESULTING FROM SUCH METHOD

This application is a continuation of U.S. patent application Ser. No. 08/643,625 filed May 6, 1996, abandoned.

BACKGROUND OF THE INVENTION

For over twenty years, the assignee of the present invention (and such assignee's predecessors-in-interest) manufactured guitar strings having enlarged ends that are elongate and that tightly enclose the string itself (the "string element"). This is to be contrasted with the more common type of enlarged end, which is formed by bending the string element around an eyelet (ball end). The first-mentioned type of enlarged end is described in U.S. Pat. Nos. 3,777,613; 3,846,888; and 3,881,236.

The enlarged end described in the cited patents is for some purposes superior to the indicated eyelet type. For example, it is more uniformly and symmetrically shaped, and fits better in a socket of a tremolo device. However, there are disadvantages (drawbacks) associated with it that until now seemed incapable of being overcome. These include (among others) the following:

1. The end of the string element was severely bent and crunched in a metal tube, which could damage or strain such end and make it susceptible to breakage or pulling-out.
2. Even if not damaged, the end of the string element was often not gripped in the enlarged end as tightly or securely as desired.
3. The bending and crunching of the end of the string element in the metal tube required two steps, one of which was transverse and one longitudinal. The manufacturing operation was such that the dies employed in at least one of these steps tended to become worn out or damaged.
4. The enlarged string end is not perfectly smooth on its exterior, instead having transverse lines or cracks in it. Thus, it is not aesthetically perfect.

SUMMARY OF THE INVENTION

In accordance with the present invention, the enlarged end can be 100% smooth, 100% symmetrical about the longitudinal axis of the string element, and 100% uniform in exterior size and shape regardless of guitar string diameter. The tools employed to connect the enlarged end to the string element need operate in only one direction, namely longitudinally of the string element. Such tools do not tend to become damaged, but instead are believed to have a long life.

The portion of the end of the string element that is primarily gripped by the enlarged end is not bent by the enlarged end—instead maintaining its straight condition so as to be only minimally subjected to the possibility of breakage-inducing strain or damage.

The pull-out strength of the connection between the string element end and the enlarged end is surprisingly high, especially in view of the straight condition of the gripped string portion. This is very important. The high pull-out strength is achieved by an unusual "extrusion" process that starts with a predetermined discrete solid metal blank (used to make the enlarged end), and ends with a piece having distinctly different dimensions than those of such blank. The high pull-out strength and other benefits are also attained by using, preferably, brass as the enlarged-end material.

The invention operates well whether the string element be plain (bare) or wound. Relative to wound strings, there is only a very small chance that the winding will be cut. It is one feature of the preferred embodiment of the invention that the extreme ends of both the wound and plain (not wound) string elements are pre-bent in simple and easy ways that increase the pull-out strength and aid in the manufacturing method.

In summary, therefore, the invention provides a radically new, different and superior guitar string having an enlarged end that (in combination with the string element) greatly exceeds in several ways the capabilities of prior-art guitar strings.

BRIEF DESCRIPTION OF THE DRAWINGS

All views are greatly enlarged.

FIGS. 3 and 4 are longitudinal sectional views of the enlarged ends of FIGS. 1 and 2, respectively;

FIGS. 5 and 6 are top plan views of FIGS. 1 and 2, respectively;

FIGS. 7 and 8 correspond, respectively, to FIGS. 3 and 4 but show the raw blanks for the enlarged ends—prior to forming;

FIG. 9 is a vertical sectional view of a die, showing a blank of either FIG. 7 or FIG. 8, just prior to being "extruded" downwardly therethrough;

DETAILED DESCRIPTION OF THE PREFERRED EMBODIMENT

Figure 1:
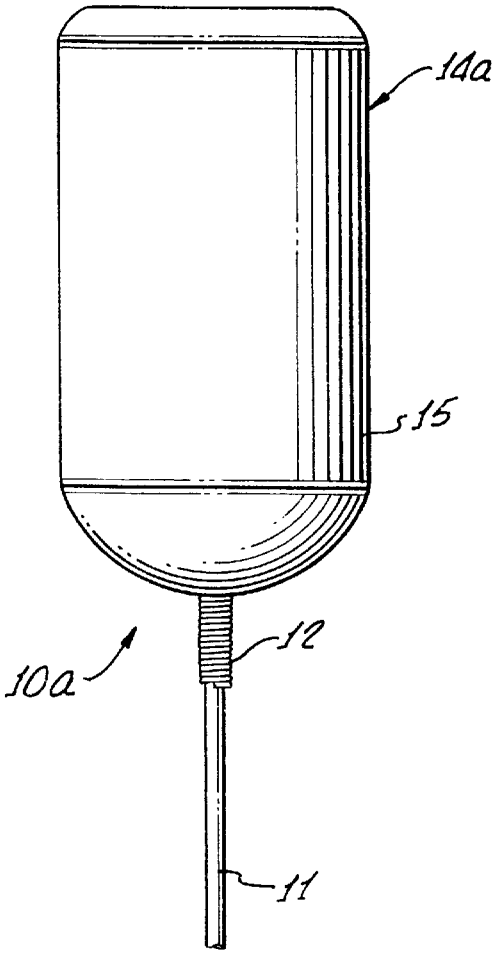
FIGS. 1 and 2 are side elevational views of the completed wound and plain strings, respectively.
Figure 2:
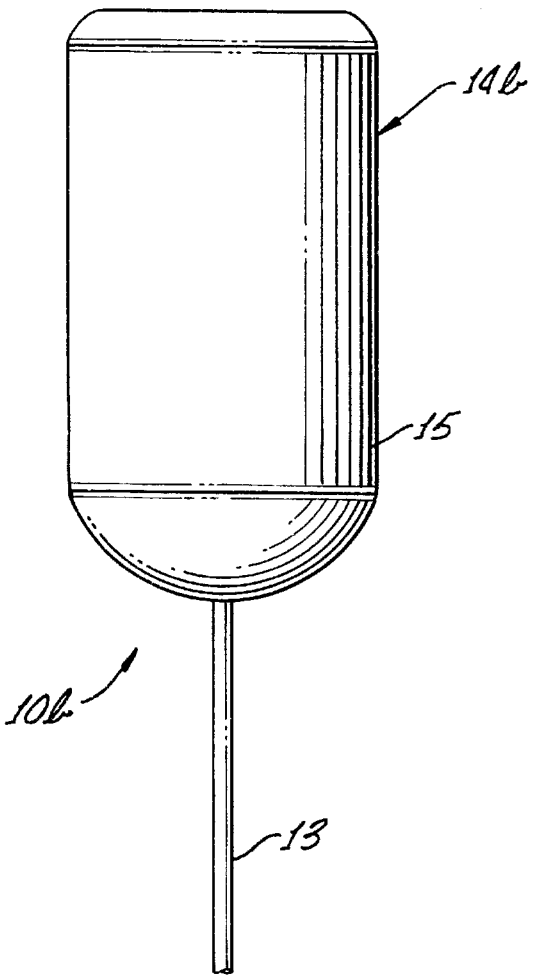

The present string is shown only at and near its enlarged end, but it is to be understood that the actual string (the "string element") is long (longer than about 30 inches). The string element is typically formed of metal, usually steel. Typical string elements are described in the cited U.S. Pat. No. 3,881,236, which is hereby incorporated by reference herein.

The words "guitar string", as used herein, include strings for electric bass guitars, banjos, mandolins, etc., in addition to standard guitars. The guitar string is used in combination with a conventional electric guitar, guitar, electric bass, etc.

Referring first to FIGS. 1–6, inclusive, there are shown completed guitar strings 10*a* and 10*b* that are respectively wound and plain. Each wound string 10*a* comprises a metal core wire 11 and a metal winding 12, which in combination are the string element. Each plain string 10*b* comprises a metal wire 13, the string element. Mounted very securely on one end portion of each element 11–12 and each element 13 is an enlarged end 14*a* or 14*b*, respectively.

Each enlarged end 14*a* or 14*b* has a metal body 15 through which extends a passage (bore or hole) 16 or 16*a* containing (respectively) the element 11–12 or element 13.

A portion 17 of body 15 encompasses a substantial part of passage 16 or 16*a*, and accordingly encompasses a substantial part of element 11–12 or element 13. Such portion 17 is, throughout substantially the entire circumference of element 11–12 or element 13, tightly compressed in radially-inward directions so as to bear radially-inwardly with great force against substantially the entire circumference of element 11–12 or element 13. The wall of passage 16 or 16*a* at portion 17 of body 15 is in close gripping engagement with substantially the entire circumference of element 11–12 or element 13.

The close gripping engagement of portion 17 with element 11–12 or element 13 is not the result of melting of metal body 15. Instead, it is the result of radial-inward forcing of solid body 15 so as to move portion 17 thereof radially-inwardly at substantially all regions surrounding the gripped element 11–12 or gripped element 13.

The gripped element 11–12 or element 13 is not bent or kinked in any significant amount. Instead, the gripped element extends generally straight along the passage 16 or 16*a*, which passage is itself generally straight.

The metal body 15 is, in accordance with one aspect of the invention, made of a metal that is capable of deformation without melting or even heating, and which will grip the enclosed element 11–12 or element 13 with great strength. Such a metal is brass. More specifically, such metal is brass having the following composition:

copper—61% zinc—36% lead—3%

In accordance with another aspect of the invention, the part of element 11–12 or element 13 that is gripped in portion 17 is wound or twisted. Thus, in the case of element 11–12, it is the winding 12 that is gripped. In the case of element 13, the wire is looped back and twisted upon itself, as shown at 18 in FIG. 4, and the twisted region 18 is what is gripped in portion 17.

In accordance with a further aspect of the invention, the extreme end of element 11–12 or element 13 is so shaped that the element 11–12 or element 13 cannot fall by gravity through passage 16 or 16*a* prior to application of gripping forces. In the case of element 11–12, the extreme end is flattened and bent or kinked as shown at the top in FIG. 3, and in FIG. 5. The flattened and bent region has the reference number 20. In the case of element 13, a loop 21 is formed at the extreme upper end. Bent end 20 and loop 21 cannot fall through passage 16 or 16*a* at any time.

There is further achieved by bent end 20 and by loop 21 increased resistance for preventing the element 11–12 or element 13 from being pulled through passage 16 or 16*a* and thus out of the body 15. Thus, the flattened kink 20 would have to be straightened and narrowed to pass through the compressed region. The loop 21 would require flattening in order to so pass.

The bent end or kink 20, or loop 21, is located in a central cavity 22 at the upper end of body 15. This improves the aesthetics of guitar string 10*a* or 10*b*. As described below, the lower end of the cavity communicates through a frustoconical transition portion with passage 16 or 16*a*. This facilitates feeding of each string element through the blank.

Each enlarged end 14*a* or 14*b* is preferably exteriorly shaped as an elongate surface of revolution about the axis of the element 11–12 or element 13 contained therein. The great majority of such surface of revolution is a cylinder 23 (FIGS. 3–6).

Except for the described passage 16 or 16*a*, and cavity 22, each enlarged end is solid. There are no voids, cracks, etc.

METHOD OF THE INVENTION

The method of manufacturing the above-described guitar string 10*a* or 10*b* is described with reference to FIGS. 7–11, inclusive.

As the first step in the method, there are provided raw blanks having a predetermined configuration and made of metal that has great strength and will cold flow. Such a metal is the brass described above.

Two such blanks are shown at 25*a* and 25*b*. Preferably, each such blank has the same exterior shape and size as the others. The diameters of interior passages and cavities in the blanks may differ. For example, blank 25*a* has an axial cylindrical bore (passage or hole) 26 the diameter of which is larger than that of a bore (passage or hole) 26*a* of blank 25*b*. These bores are, respectively, sized to receive element 11–12 and element 13, the latter being received at the twisted portion 18 thereof as well as at its straight portion.

The bore diameters are so selected, in relation to factors including the sizes of the string elements, that the gripping step described below will cause the above-described tight gripping of element 11–12, or of portion 18 of element 13. After completion of the method, bore 26 (FIG. 7) has been reduced in diameter along the majority of the length thereof, and has become passage 16 (FIG. 3). Bore 26*a* has likewise been reduced in diameter along the majority of its length, and has become passage 16*a* (FIG. 4).

Bore 26 (FIG. 7) connects axially through a frustoconical transition portion 27 with the above indicated cavity, which is cylindrical and is here numbered 22*a*. Bore 26*a* (FIG. 8) connects axially through a frustoconical transition portion 27*a* with cylindrical cavity 22*a*. The respective bores, cavities and transition portions are coaxial with each other.

The described upper string element portions 20 and 21 seat on the frustoconical walls, and this prevents dropping of element 11–12 or element 13 through bore 26 or 26*a*.

The shape of the exterior of each blank 25*a* and 25*b* is as follows. It is a surface of revolution about the axis of the blank, namely about the axis of bore 26 or 26*a*. The majority of such surface of revolution is a cylinder 29. At its lower end, which lower end is numbered 30 in FIGS. 7–9, the cylindrical surface 29 meets the upper end of a downwardly-convergent frustoconical surface 31. Such surface 31 tapers at a small angle, for example 4 degrees from the vertical (from the wall of the cylindrical surface 29).

At its lower end, numbered 32, frustoconical surface 31 meets the upper-outer end of another downwardly-convergent frustoconical surface, numbered 33, having much more taper, for example 45 degrees from vertical (from the wall of cylinder 29).

At its lower end, numbered 34, the last-mentioned frustoconical surface 33 meets the upper end of a spheroidal surface 35 that extends down to the lower end of bore 26 or 26*a*. The upper end of each blank 25*a* or 25*b* is bevelled as shown at 36, and has a central horizontal surface 36*a*.

Preferably, each raw blank, such as 25*a* and 25*b*, is formed by machining the exterior surface on a screw machine, and drilling the bore and counterbore (cavity 22*a*) by high-speed drilling.

As the next step in the method, there is provided a hardened steel die 38 that is supported in (for example) a suitable die base 39 having an open bottom.

A straight die passage (bore) 41 extends all the way from the top of the die 38 to the bottom thereof. The wall of passage 41 is correlated to the above-described raw blanks (such as 25*a* and 25*b*) in such a manner that forcing ("extruding") of each blank down through (and out) the die creates the above-indicated large radial-inward forces all around the element 11–12 or element 13, and results in the described gripping of each string element by the enlarged end.

The relationships are such that each blank (such as 25*a* or 25*b*) will become both longer (vertical dimension) and smaller in diameter (radial dimensions) as the result of traversing the die passage 41 from top to bottom. Stated otherwise, the relationships are such that each combination of element 11–12 and (for example) blank 25*a* (FIG. 7) will be transformed into the combination of 11–12 and (for example) enlarged end 14*a* (FIG. 3). This may be called, as above indicated, a type of "extrusion", but is unlike conventional extrusion in which an amorphous mass of metal is involved.

Similarly, the relationships are such that each combination of element 13 and (for example) blank 25*b* (FIG. 8) will be transformed into the combination of element 13 and (for example) enlarged end 14*b* (FIG. 4).

Referring to FIG. 9, passage of bore 41 has an elongate frustoconical wall 42 that converges downwardly all the way from upper surface 43 of the die to a horizontal circle 44 that is spaced above bottom die surface 45. Between circle 44 and surface 45, passage 41 has a cylindrical wall 46. Wall 46 and circle 44 have the same diameter.

The raw blank (such as 25*a* or 25*b*) having been provided, and the die 38 having been provided, the next step in the method comprises providing string element 11–12 and string element 13. In the case of element 11–12, the flattened and bent (kinked) region 20 is formed in any suitable way, for example in a small automatic pneumatic press. In the case of element 13, regions 18 and 21 are preferably formed by the same machines that mount the above-indicated eyelets (ball ends) in loops (such as 21). This is an advantage, because long-known conventional machinery is used to make the twist 18 and loop 21.

As the next step, the combination 11–12 and 25*a*, or the combination 13 and 25*b*, is made and provided in the die passage 41 (FIG. 9). Thus, the element 11–12 may first be threaded through blank 25*a* (or element 13 first threaded through blank 25*b*) following which the element and blank are threaded into the position shown in FIG. 9. Alternatively, blank 25*a* or 25*b* may first be dropped into the upper end of die passage 41, following which the element 11–12 or element 13 is threaded downwardly through blank bore 26 or 26*a*, and through die passage 41, to the illustrated position. In either case, the blank 25*a* or 25*b* seats in the upper end portion of passage 41 (because of the blank-die size relationships), and the element extends through such passage.

As the next step, downward force is applied to the upper end of the blank, to push the blank all the way down passage 41 and out the bottom end thereof. As the blank moves down, the element 13 or element 11–12 moves down ahead of it. The force is preferably applied by the piston rod 48 of a hydraulic cylinder (not shown). Rod 48 has sufficient length to force ("extrude") blank 25*a* or 25*b* all the way down and out the bottom end of the die passage. However, by the time the blank extrudes out the lower end of the die it is no longer a blank but instead a fully completed enlarged end 14*a* or 14*b* that is both longer and smaller in diameter than the blank.

By the one downward stroke of piston rod 48, the guitar string 10*a* or 10*b* (FIGS. 1 and 2) is fully completed. It remains only to put it in a package.

It is an aspect of the preferred form of the method that the steps are performed in the illustrated vertical positions, so that gravity will hold the element 11–12 or element 13 in proper position prior to and during the gripping step. The enlarged end is at the top, and the element 11–12 or element 13 hangs down through the passage 26 or 26*a*. The passage is itself oriented vertically, as shown. The die is also oriented vertically, as is its passage 41, so that the element 11–12 or element 13 hangs and feeds vertically-downwardly therethrough.

It is also to be understood that the lower end of piston rod 48 closes cavity 22, making sure that the string element cannot move upwardly a substantial distance relative to the blank 25*a* or 25*b*.

Figure 10:
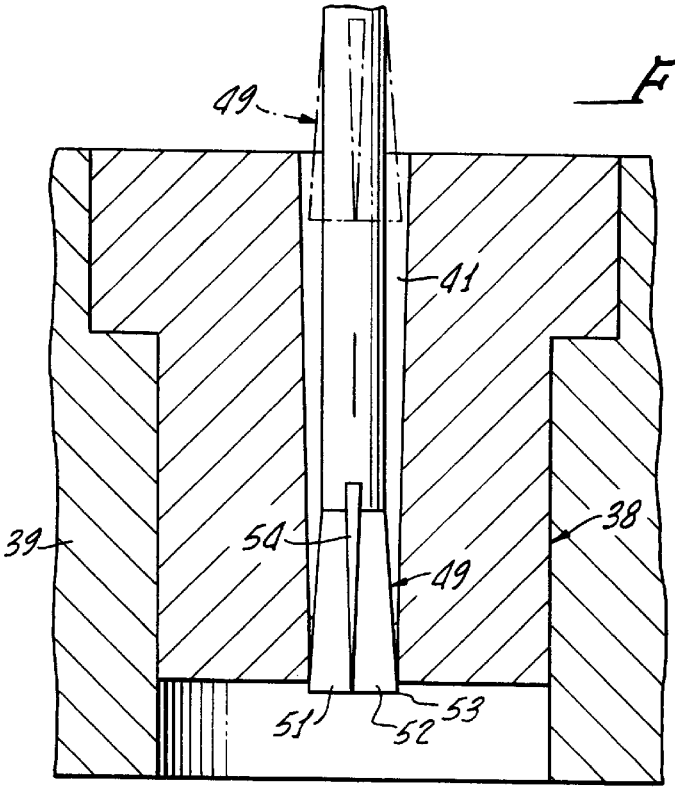
FIGS. 10 and 11 correspond to FIG. 9 but show the steps of cleaning and lubricating the die.
Figure 11:
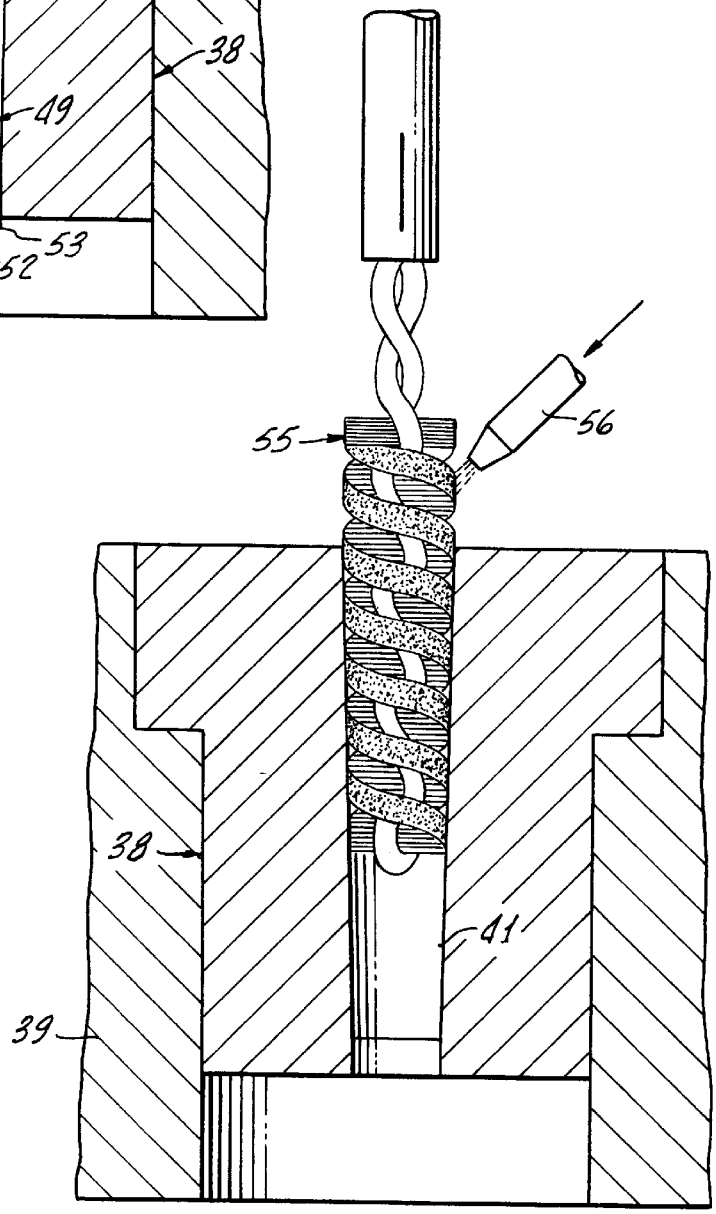

Referring next to FIGS. 10 and 11, there are shown method steps by which die 38 is maintained in excellent operating condition for long periods of time. FIG. 10 shows a scraper 49 that scrapes the full operating length of the wall of die passage 41, between each forming (extrusion) step. Such scraper is operated by a hydraulic cylinder, not shown.

The preferred scraper has three downwardly-extending prongs, two of which are shown at 51 and 52. The lower scraping edges 53 of the prongs are curved and correlated to scrape substantially the full die wall, as the scraper moves down from its top position (shown in phantom) to its illustrated bottom position (at which the edges 53 have emerged from the die passage). Thus, the scraping edges 53 of the three prongs are curved substantially correspondingly to the curvature of the die passage wall.

The prongs 51–52 (and the unshown third prong) are somewhat resilient, being formed of steel that is somewhat less hard than the steel at the die passage walls 42, 46. The prongs are separated by three longitudinal slots one of which is shown at 54. The slots are sufficiently wide that the scraping edges move substantially together as they emerge from the lower end of passage 41.

Scraping edges 53 remove any residual brass from the die walls. Then, as shown in FIG. 11, such die walls are brushed and lubricated. For example, a brush 55 in the nature of a bottle brush may be moved down and up the die passage 41.

Lubrication is preferably effected by dripping a light oil, either directly into passage 41 or onto brush 55. An oil nozzle is schematically indicated at 56.

SPECIFIC EXAMPLES

The same die 38 is used for all strings, both wound and plain. As a specific example of the die, the distance from top surface 43 to bottom surface 45 is 24 mm. The distance from circle 44 to bottom surface 45 is 2 mm. The diameter of wall 42 at the upper end of the passage 41 (at wall 43) is 5 mm. The diameter of circle 44 and of wall 46 is 4.25 mm.

In a typical wound string 14*a* (FIG. 1), the winding 12 (outer diameter of the wound string) has a diameter of 0.56 mm. For such string, the following dimensions are exemplary:

Diameter of cylindrical surface 29 of blank 25*a*—4.9 mm

Diameter of bore 26 thereof—1.0 mm

Diameter of cavity 22*a* thereof—2.0 mm

Diameter of circle 34 thereof—4.2 mm

Total length thereof—7.0 mm

Diameter of enlarged end 14*a* after extrusion—4.25 mm

Length of enlarged end 14*a* after extrusion—8.2 mm

In a typical plain string 14*b* (FIG. 2), element 13 has a diameter of 0.25 mm. For such string, the following dimensions are exemplary:

Diameter of cylindrical surface 29 of blank 25*b*—4.9 mm

Diameter of bore 26 thereof—0.9 mm

Diameter of cavity 22*a* thereof—2.0 mm

Diameter of circle 34 thereof—4.2 mm

Total length thereof—7.0 mm

Diameter of enlarged end 14*b* after extrusion—4.25 mm

Length of enlarged end 14*b* after extrusion—8.2 mm

The above-stated brass is employed in the above specific examples.

The foregoing detailed description is to be clearly understood as given by way of illustration and example only, the spirit and scope of this invention being limited solely by the appended claims.

What is claimed is:

1. A guitar string, which comprises:

(a) an elongate guitar string element, and (b) an enlarged end mounted on an end of said element, said enlarged end having a metal body having a passage therethrough, said element extending through said passage, said passage having a wall portion, said wall portion being defined by a portion of said body that encompasses said wall portion and that is forced radially-inwardly and tightly compressed in radially-inward directions so as to cause said wall portion to bear radially-inwardly with great force against substantially the entire circumference of said element, so that said wall portion is in close gripping contact with said element at substantially the entire circumference of said element.

2. The invention as claimed in claim 1, in which said metal is brass.

3. The invention as claimed in claim 1 in which said element has a portion in said enlarged end and has a portion not in said enlarged end that is adjacent said portion in said enlarged end, and in which said passage and the element therein are straight and are coaxial with said adjacent portion of said element not in said enlarged end.

4. The invention as claimed in claim 1, in which said element is plain.

5. The invention as claimed in claim 1, in which said element is wound.

6. The invention as claimed in claim 1, in which said element has an extreme end that includes a twisted portion, said twisted portion being in said passage and being gripped by said wall portion.

7. The invention as claimed in claim 1, in which said element is wound and has a bent extreme end at said enlarged end.

8. The invention as claimed in claim 1, in which said element is plain and has a looped and twisted extreme end at said enlarged end.

9. The invention as claimed in claim 1, in which said enlarged end has a cavity communicating with said passage, said cavity containing an extreme end of said element.

10. A guitar string of the wound type, which comprises:

(a) an elongate guitar string element comprising a metal core wire on which a metal winding is provided, and (b) an elongate enlarged end formed of metal and having a body, the majority of the outer surface of said body being a cylinder, said body having a straight passage axially therethrough and with which said cylinder is coaxial, said element extending through said passage, the portion of said body surrounding at least a significant part of said passage and element therein being tightly compressed in radially-inward directions so as to bear radially-inwardly with great force against substantially the entire circumference of said element, so that the wall of said passage closely engages and tightly grips said element around substantially the entire circumference of said element.

11. The invention as claimed in claim 10, in which the metal of which said enlarged end is made is brass.

12. The invention as claimed in claim 10, in which said body has a cavity at one end thereof and communicating with said passage, and in which the extreme end of said element is bent and somewhat flattened and is disposed in said cavity.

13. A guitar string of the plain type, which comprises:

(a) an elongate guitar string element comprising a metal wire that is not wound, and (b) an elongate enlarged end formed of metal and having a body, the majority of the outer surface of said body being a cylinder, said body having a straight passage axially therethrough and with which said cylinder is coaxial, said element extending through said passage, the portion of said body surrounding at least a significant part of said passage and element therein being tightly compressed in radially-inward directions so as to bear radially-inwardly with great force against substantially the entire circumference of said element, so that the wall of said passage closely engages and tightly grips said element around substantially the entire circumference of said element.

14. The invention as claimed in claim 13, in which the metal of which said enlarged end is made is brass.

15. The invention as claimed in claim 13, in which said body has a cavity at one end thereof and communicating with said passage, and in which the end of said element is twisted, and in which said twisted end is in said passage and grippingly engaged by said wall.

16. A method of providing an enlarged end on a guitar string element, which comprises:

(a) providing an elongate guitar string element, (b) providing a metal blank and performing machining and drilling operations on said blank in order to cause said blank to have a body having an axis and through which a passage extends along said axis of said body, (c) mounting a portion of said element in said passage, and (d) exerting sufficiently large radial-inward pressure against the periphery of said body to force the wall of said passage radially-inwardly against said element into tight gripping relationship with said element around substantially the entire circumference of said element, and to cause said wall of said passage to be tightly compressed in radially-inward directions so as to bear radially-inwardly with great force against substantially the entire circumference of said element.

17. A method of providing an enlarged end on a guitar string element, which comprises:

(a) providing an elongate guitar string element, (b) providing a blank formed of metal and having a hole therein, (c) providing a die having an elongate passage therein the walls of which converge in a predetermined direction, (d) inserting said element into said hole in said blank, and inserting said blank into said die passage, and (e) forcing said blank longitudinally of said passage in said predetermined direction to cause said walls to apply inward pressure on said blank so that said element is gripped by said blank.

18. The invention as claimed in claim 17, in which said method further comprises causing said enlarged end to be formed of brass.

19. The invention as claimed in claim 17, in which said method further comprises inserting said element through said die passage, and causing said element to move in said die passage ahead of said blank during said step of forcing said blank longitudinally of said die passage.

20. The invention as claimed in claim 19, in which said method further comprises moving said blank out of said die passage in said predetermined direction, so that said element is also moved out of said die passage in said predetermined direction.

21. The invention as claimed in claim 20, in which said method further comprises causing said element to move in said die passage in response to forces including gravity.

22. A method of providing an enlarged end on a guitar string element, which comprises:

(a) providing a die having an elongate die passage therethrough, said passage having an inlet end on one side of said die and an outlet end on the other side of said die, said passage having a generally frustoconical wall that converges in a direction from said inlet end toward said outlet end, (b) providing a raw blank formed of metal, the outer surface of said blank being a surface of revolution, said blank having a bore therethrough coaxial with said surface of revolution, (c) providing a guitar string element, (d) inserting said element through said bore and through said die passage, and inserting said blank into said inlet end of said die passage, (e) forcing said blank through said die passage and out said outlet end of said die passage, said element also passing out said outlet end, and (f) so correlating said surface of revolution, and said bore, and said frustoconical wall that said forcing step (e) causes the wall of said bore to tightly grip said element.

23. The invention as claimed in claim 22, in which said method further comprises causing said blank to be formed of brass.

24. The invention as claimed in claim 22, in which said method further comprises scraping said wall of said die passage when said blank is not present therein, to clean said wall.

25. The invention as claimed in claim 24, in which said method further comprises lubricating said wall of said die passage.

26. The invention as claimed in claim 22, in which said method further comprises scraping said wall of said die passage when said blank is not present therein, to clean said wall, lubricating said wall of said die passage, and brushing said wall of said die passage.

27. The invention as claimed in claim 22, in which said last mentioned step (f) is so performed that said blank becomes both longer and smaller in diameter as it passes from said inlet end of said die passage to and out said outlet end thereof.

28. The invention as claimed in claim 27, in which said method further comprises employing as said element a metal core wire wound in metal.

29. The invention as claimed in claim 27, in which said method further comprises employing as said element a wire that is not wound.

30. The invention as claimed in claim 28, in which said method further comprises bending one end of said element and causing said one end to be adjacent said blank, said bending being sufficient to prevent said one end from passing through said bore as the result of gravity.

31. The invention as claimed in claim 29, in which said method further comprises bending one end of said element and twisting it in relation to an adjacent part of said element, thus forming a twisted region, and further comprises locating said twisted region in said bore so that it is gripped by said bore wall.

32. The invention as claimed in claim 31, in which said method further comprises forming a loop on said one end, said loop preventing passage through said bore.

33. The invention as claimed in claim 22, in which said method further comprises orienting said die in an upright position, with said inlet end above said outlet end.

34. A method of providing an enlarged end on a guitar string element, which comprises:

(a) providing a blank having a hole through it, (b) threading a guitar string element through said hole, and (c) passing said blank through an extrusion die to make said blank smaller in diameter to thereby cause said blank to grip said element.

35. A method of providing an enlarged end on a guitar string element, which comprises:

(a) providing an elongate guitar string element, (b) providing a blank formed of metal, and having an elongate body through which an elongate passage extends in a direction longitudinal to said body, (c) pre-bending an end of said element to a shape such that the pre-bent end resulting from said pre-bending increases the pull-out strength resisting pulling of said element out of the enlarged end, (d) threading said element through said passage until said pre-bent end is adjacent an end of said elongate passage, and (e) applying radially inward force against said body at regions outward of said elongate passage to move the wall of said passage radially inward and cause said wall of said passage to grip against said element and create gripping force that augments said pull-out strength resisting pulling of said element out of the enlarged end.

36. The invention as claimed in claim 35, in which said blank has a cavity therein adjacent said end of said passage and communicating with said passage and which is adapted to receive said pre-bent end, and in which said threading step is such that said pre-bent end is disposed in said cavity.

37. A guitar string, which comprises:

(a) an elongate guitar string element having a main body and having an axis, said guitar string element being formed primarily of springy steel, and (b) a machined enlarged end formed of metal and mounted on one end of said element, said one end of said element being disposed in a hole in said enlarged end, said enlarged end being symmetrical about said axis of said element, said enlarged end being exteriorly shaped as an exterior surface of revolution about said axis of said element, said exterior surface of revolution having an exterior end portion on the end thereof that is nearest said main body of said element, said exterior end portion of said surface of revolution converging in a direction toward said main body of said element, characterized in that said exterior surface of revolution is smooth and crack free, and further characterized in that said one end of said element does not have any knot therein, and further characterized in that said enlarged end is in gripping relationship to said one end of said element said enlarged end exerting sufficiently large radially-inward pressure against the periphery of said element to provide pull-out strength resisting pulling of said one end of said element out of said hole in said enlarged end.

38. The invention as claimed in claim 37, in which said enlarged end is made of brass.

39. The invention as claimed in claim 37, in which said guitar string element is a plain string formed of music wire.

40. The invention as claimed in claim 37, in which said guitar string element is a wrapped string having a springy steel core and a relatively soft metal winding.

41. The invention as claimed in claim 39, in which said one end of said element is twisted upon itself, thus forming a twisted region, and in which said twisted region is in said hole and is gripped by the wall of said hole.

42. The invention as claimed in claim 37, in which said guitar string, including said elongate guitar string element and said enlarged end, is part of a set of such guitar strings, various strings in said set having diameters different from each other, each enlarged end in said set of guitar strings being identical in diameter and shape to each other enlarged end in said set of guitar strings.

43. The invention as claimed in claim 42, in which one of said holes is provided in each enlarged end in said set of guitar strings, and in which said holes in different enlarged ends in said set have diameters that differ from each other.

* * * * *